US011808259B2

(12) United States Patent
Pendleton et al.

(10) Patent No.: US 11,808,259 B2
(45) Date of Patent: Nov. 7, 2023

(54) DOUBLE ACTING PUMP DESIGN UTILIZING TWO ROTATING DISCS

(71) Applicant: GARTECH, LLC, Houston, TX (US)

(72) Inventors: Gary Pendleton, Shotley Bridge (GB); Gary Warren Stratulate, Houston, TX (US)

(73) Assignee: GARTECH, LLC, Houston, TX (US)

( * ) Notice: Subject to any disclaimer, the term of this patent is extended or adjusted under 35 U.S.C. 154(b) by 0 days.

(21) Appl. No.: 17/197,709

(22) Filed: Mar. 10, 2021

(65) Prior Publication Data

US 2022/0228581 A1 Jul. 21, 2022

Related U.S. Application Data

(63) Continuation of application No. PCT/US2021/014155, filed on Jan. 20, 2021.

(60) Provisional application No. 63/033,026, filed on Jun. 1, 2020, provisional application No. 62/963,703, filed on Jan. 21, 2020.

(51) Int. Cl.

| | |
|---|---|
| ***F04B 5/02*** | (2006.01) |
| ***F04B 1/122*** | (2020.01) |
| ***F04B 9/02*** | (2006.01) |
| ***F04B 1/146*** | (2020.01) |
| ***F04B 1/143*** | (2020.01) |
| ***F04B 1/145*** | (2020.01) |

(52) U.S. Cl.

CPC ..... *F04B 5/02* (2013.01); *F04B 1/122* (2013.01); *F04B 1/143* (2013.01); *F04B 1/145* (2013.01); *F04B 1/146* (2013.01); *F04B 9/02* (2013.01)

(58) Field of Classification Search

CPC ..... F04B 1/122; F04B 1/143; F04B 1/145; F04B 1/146; F04B 1/14; F04B 5/02; F04B 9/02; F04B 53/16

USPC ..... 417/454, 537

See application file for complete search history.

(56) References Cited

U.S. PATENT DOCUMENTS

| | | | | | |
|---|---|---|---|---|---|
| 2,095,316 | A * | 10/1937 | Davis, Jr. | F04B 1/143 | 417/521 |
| 2,534,153 | A * | 12/1950 | Widmer | F04B 1/146 | 417/494 |
| 2,982,215 | A * | 5/1961 | Baker | F04B 1/184 | 91/503 |
| 3,811,798 | A * | 5/1974 | Bickford | F04B 1/122 | 417/269 |
| 5,171,136 | A * | 12/1992 | Pacht | F04B 53/1025 | 417/571 |
| 8,074,679 | B2 * | 12/2011 | Jensen | F04B 53/1032 | 417/454 |
| 8,109,737 | B1 * | 2/2012 | Gamble | F01B 1/08 | 92/138 |
| 2016/0025080 | A1 * | 1/2016 | Zafar | F04B 1/146 | 92/13 |

(Continued)

FOREIGN PATENT DOCUMENTS

CA 2254360 * 11/1997

*Primary Examiner* — Charles G Freay

(74) *Attorney, Agent, or Firm* — Ewing & Jones, PLLC

(57) ABSTRACT

Embodiments provide for two rotating parallel discs to power horizontal pistons back and forth configured in a radial pattern, comprised of double acting fluid end that may be used in high pressure fluid handling equipment, wherein the fluid end has an arrangement that acts upon both a suction and a discharge operation.

20 Claims, 15 Drawing Sheets

(56) References Cited

U.S. PATENT DOCUMENTS

2019/0323491 A1* 10/2019 Calmer ..... F04B 27/10

* cited by examiner

1,600-hp, 7,500-psi, 12-in stroke

| Pump Speed | | | 120 | 110 | 100 | 90 | 80 | 70 | 60 | 50 | 30 |
|---|---|---|---|---|---|---|---|---|---|---|---|
| Max output power | | | 1,600 | 1326 | 1205 | 1005 | 904 | 844 | 723 | 603 | 357 |
| Liner size (mm) | Max discharge press. psi | Volume / stroke gal US | | | Output gal US/min | | | | | | |
| 4.50 | 7550 | 2.49 | 291 | 273 | 241 | 223 | 198 | 171 | 149 | 124 | 74 |
| 5 | 6772 | 3.05 | 391 | 337 | 306 | 285 | 245 | 214 | 184 | 151 | 92 |
| 5.5 | 5555 | 3.70 | 444 | 407 | 370 | 333 | 296 | 259 | 223 | 185 | 113 |
| 6.5 | 4868 | 4.41 | 529 | 485 | 451 | 397 | 353 | 308 | 264 | 220 | 132 |
| 7 | 3429 | 5.17 | 621 | 569 | 517 | 465 | 414 | 352 | 310 | 259 | 156 |
| 7.5 | 2947 | 6.60 | 826 | 757 | 628 | 630 | 551 | 493 | 413 | 344 | 207 |

FIG. 2 (PRIOR ART)

DOUBLE ACTING PUMP DESIGN UTILIZING TWO ROTATING DISCS

CROSS-REFERENCE TO RELATED APPLICATIONS

This application is a Continuation Application of PCT/US2021/014155 filed Jan. 20, 2021, which claims priority from U.S. 62/963,703 filed Jan. 21, 2020, and 63/033,026 filed Jun. 1, 2020.

FIELD OF THE INVENTION

Aspects of the disclosure relate to pumps. More specifically, aspects of the disclosure provide for a double acting pump that may be used in fluid transfer applications, wherein the double acting pump utilizes two rotating tapered discs to actuate a piston.

BACKGROUND INFORMATION

Currently, there are a variety of types of positive displacement pumps (PD) that include single-acting reciprocating pumps. As time has progressed, the demand for efficient pumping systems continues to grow. This growth can be attributed to increasing demand from the oil & gas industry, as these pumps can deliver high pressures needed for oil field activities. Conventional pumps attempt to have a capacity that is not affected by external forces, such as external liquid forces, thus making them an ideal choice at places where the inlet forces are low. One such conventional pump system is illustrated in FIG. 1.

Positive displacement (PD) pumps are further segmented into reciprocating pumps, rotary pumps, and others. Rotary pumps are different from positive displacement pumps, owing to their ability to facilitate flow even at differentiating pressures and viscosity conditions. They are used in the lubrication of processing equipment, wind turbines, and hydraulic fracturing trucks.

In a positive displacement reciprocating pump, through the suction valve, fluid is pushed into the intake stroke cylinder and then, through the outlet valves, it is discharged on the discharge stroke cylinder under positive pressure. There is only one suction valve and discharge valve per cylinder. The discharge is changed only when the pumping speed is changed. Due to its unique character to provide constant discharge, the product is highly popular in industries such as chemical, power, and others.

The use of positive displacement pumps is rising globally as its application scope is widening in water treatment, oil and gas, chemical, and food & beverage industries. This is mainly due to the ability of positive displacement pumps to operate effectively under diverse conditions including high viscosity operations, high-pressure operations, and differential flow pressure operations.

In a positive displacement rotary pump, the fluid movement is achieved by mechanical displacement of liquid. The liquid displacement is attained by using a rotation principle. The rotation creates a vacuum, which captures and draws the fluid. These products are more efficient as they naturally remove the air present in the lines along with the fluid.

Mud pumps used in the oil and gas industry are a positive displacement reciprocating mud pump. These pumps are used extensively throughout the oil & gas industry and have the capability of moving different constituent 'muds' for purposes of drilling and well control.

Mud pumps are based on a single acting reciprocating pump action, via connecting rods and a crankshaft to provide a forward motion for the piston operation. The number of pistons typically is 3 or 5.

There is a need to provide a pump mechanism that is more efficient than conventional direct action pumps.

There is a further need to provide a pump mechanism that is easy to manufacture and maintain in field conditions.

There is a further need to provide a pumping system/arrangement that may accommodate different types of muds used in the industry.

There is a further need to provide a pumping system/arrangement that will have the advantages of single action reciprocating pumps, but that have a greater efficiency compared to such units.

SUMMARY

So that the manner in which the above recited features of the present disclosure can be understood in detail, a more particular description of the disclosure, briefly summarized below, may be had by reference to embodiments, some of which are illustrated in the drawings. It is to be noted that the drawings illustrate only typical embodiments of this disclosure and are therefore not to be considered limiting of its scope, for the disclosure may admit to other equally effective embodiments without specific recitation. Accordingly, the following summary provides just a few aspects of the description and should not be used to limit the described embodiments to a single concept.

In one example embodiment, an arrangement is disclosed. The arrangement may comprise a shaft and two parallel tapered rotating discs bearing mounted on the shaft, such discs configured to rotate with the shaft, wherein a first portion of a first of the two parallel tapered rotating discs maintains a fixed distance between a corresponding second portion of a second of the two parallel tapered rotating discs during rotation of both of the two parallel tapered rotating discs with the shaft. The arrangement may also comprise at least one block arranged in a radial pattern between the two parallel tapered rotating discs; each of the at least one blocks having at least one void in each block. The arrangement may also comprise a piston located within the at least one void in the block, the piston configured to translate from a first position to a second position, between the tapered rotating discs. The arrangement may also comprise a first housing connected to the block, the first housing having a suction side and a discharge side, the first housing configured to channel a fluid. The arrangement may also comprise a second housing connected to the block, the second housing having a suction and a discharge side, the second housing configured to channel the fluid. The arrangement may also comprise at least a first suction check valve and a first discharge check valve located in the first housing. The arrangement may also comprise at least a second suction check valve and a second discharge check valve located in the second housing.

In another example embodiment, a method is disclosed. The method may comprise providing a fluid stream to a pump with two rotating tapered discs configured to rotate with a shaft and directing the fluid stream to at least one block having a piston. The method may also comprise rotating each of the two rotating tapered discs with the shaft, causing the at least one piston to translate with the at least one block, such translation creating both a suction and a compression within the block during the translation and moving the fluid stream in the at least one block during each compression stroke of the piston.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the drawings. It is to be noted, however, that the appended drawings illustrate only typical embodiments of this disclosure and are therefore not to be considered limiting of its scope, for the disclosure may admit to other equally effective embodiments.

FIG. 2 is a table of performance values of the conventional mud pump illustrated in FIG. 1.

Figure 1:
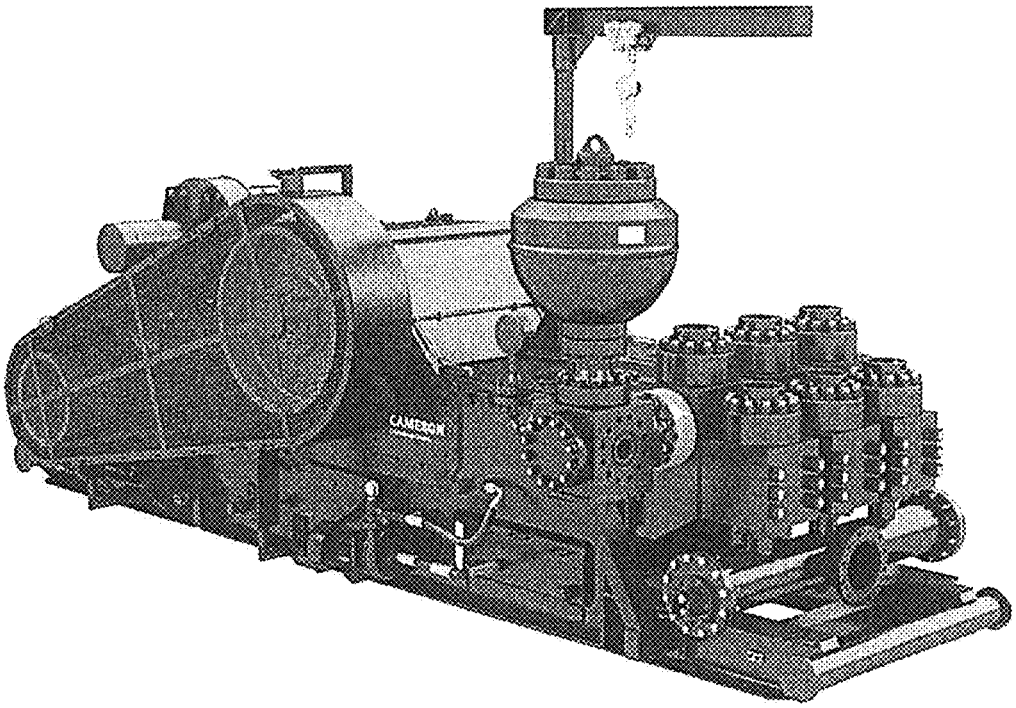
PRIOR ART FIG. 1
FIG. 1 is a perspective view of a conventional mud pump.

To facilitate understanding, identical reference numerals have been used, where possible, to designate identical elements that are common to the figures ("FIGS"). It is contemplated that elements disclosed in one embodiment may be beneficially utilized on other embodiments without specific recitation.

DETAILED DESCRIPTION

In the following, reference is made to embodiments of the disclosure. It should be understood, however, that the disclosure is not limited to specific described embodiments. Instead, any combination of the following features and elements, whether related to different embodiments or not, is contemplated to implement and practice the disclosure. Furthermore, although embodiments of the disclosure may achieve advantages over other possible solutions and/or over the prior art, whether or not a particular advantage is achieved by a given embodiment is not limiting of the disclosure. Thus, the following aspects, features, embodiments and advantages are merely illustrative and are not considered elements or limitations of the claims except where explicitly recited in a claim. Likewise, reference to "the disclosure" shall not be construed as a generalization of inventive subject matter disclosed herein and should not be considered to be an element or limitation of the claims except where explicitly recited in a claim.

Although the terms first, second, third, etc., may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first", "second" and other numerical terms, when used herein, do not imply a sequence or order unless clearly indicated by the context. Thus, a first element, component, region, layer or section discussed herein could be termed a second element, component, region, layer or section without departing from the teachings of the example embodiments.

When an element or layer is referred to as being "on," "engaged to," "connected to," or "coupled to" another element or layer, it may be directly on, engaged, connected, coupled to the other element or layer, or interleaving elements or layers may be present. In contrast, when an element is referred to as being "directly on," "directly engaged to," "directly connected to," or "directly coupled to" another element or layer, there may be no interleaving elements or layers present. Other words used to describe the relationship between elements should be interpreted in a like fashion. As used herein, the term "and/or" includes any and all combinations of one or more of the associated listed terms.

Some embodiments will now be described with reference to the figures. Like elements in the various figures will be referenced with like numbers for consistency. In the following description, numerous details are set forth to provide an understanding of various embodiments and/or features. It will be understood, however, by those skilled in the art, that some embodiments may be practiced without many of these details, and that numerous variations or modifications from the described embodiments are possible. As used herein, the terms "above" and "below", "up" and "down", "upper" and "lower", "upwardly" and "downwardly", and other like terms indicating relative positions above or below a given point are used in this description to more clearly describe certain embodiments.

Figure 6:
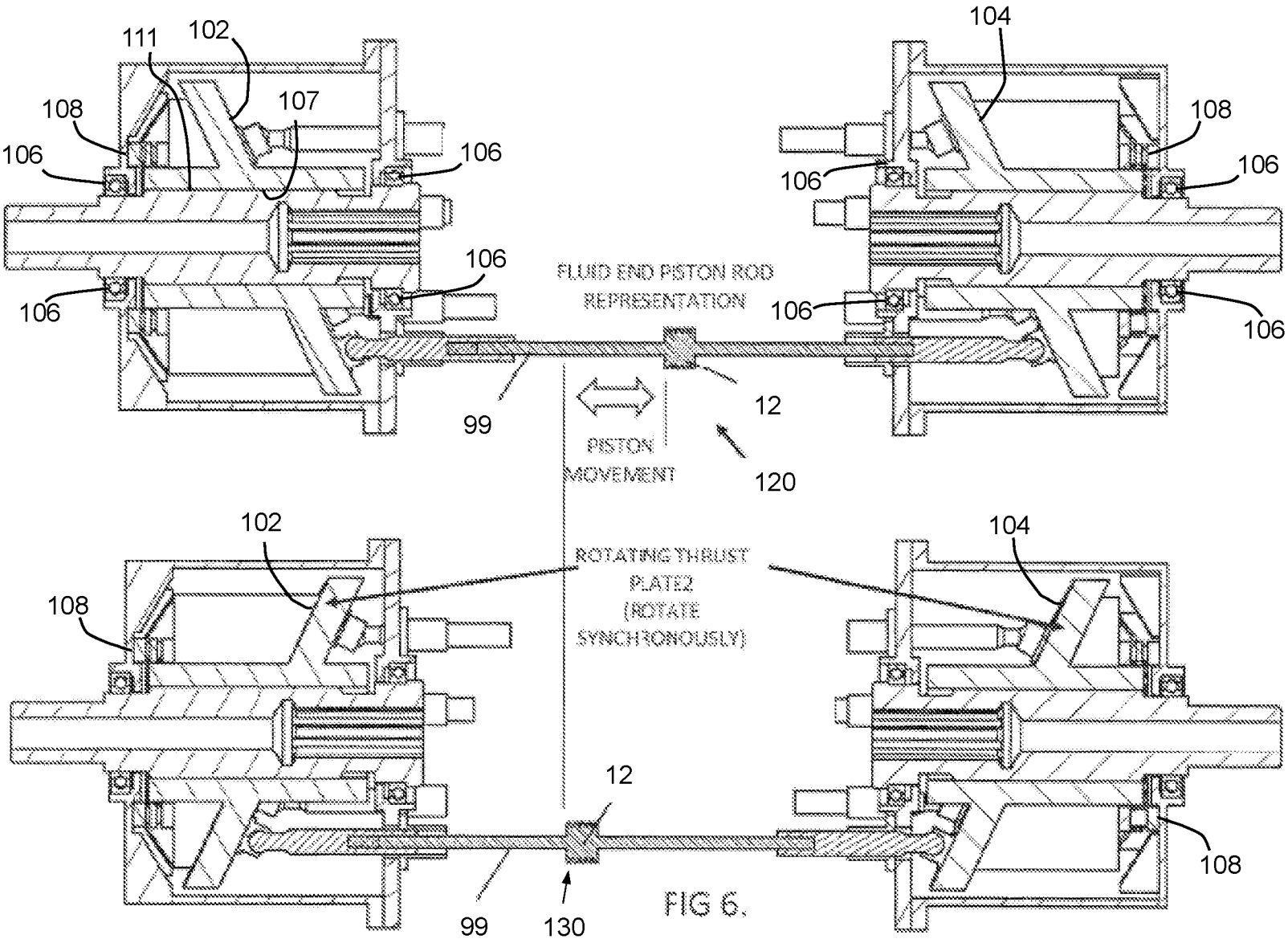
FIG. 6 is a piston movement representation for the two rotating tapered disc double acting pump arrangement of FIG. 3.

As provided herein, embodiments provide for a double acting pump arrangement 10 that has the capability of performance not achieved by conventional apparatus. For purposes of definition, when a piston or rod moves in a fluid in both directions of a piston 12 movement, the action is defined to be "double acting". Such a configuration is significantly different than conventional pumps that have a "single" action or fluid movement capability in only one direction, such as a compression stroke. Embodiments of the disclosure provide for an arrangement 10 that uses a set of tapered rotating discs 102, 104 (2 discs—1 on each end). Such tapered rotating discs 102, 104 are illustrated in FIG. 6. As provided in this embodiment, the tapered rotating discs 102, 104 are connected to individual pistons 12 that run through a block 14 (described in relation to FIG. 10). These pistons 12 have a mechanical connection on one side to a first of the two tapered rotation discs 102 and to a second of the two fixed rotating discs 104. As the discs 102, 104 rotate, the piston 12 is moved within the block 14 from a first position 120 to a second position 130. The movement of the piston 12 from the first position 120 to the second position 130 pumps fluid based upon which side of the block 14 is experiencing compression. Valving, described later, prevents back flow of fluid into the block 14 once the fluid has been pushed from the block 14.

Figure 3:
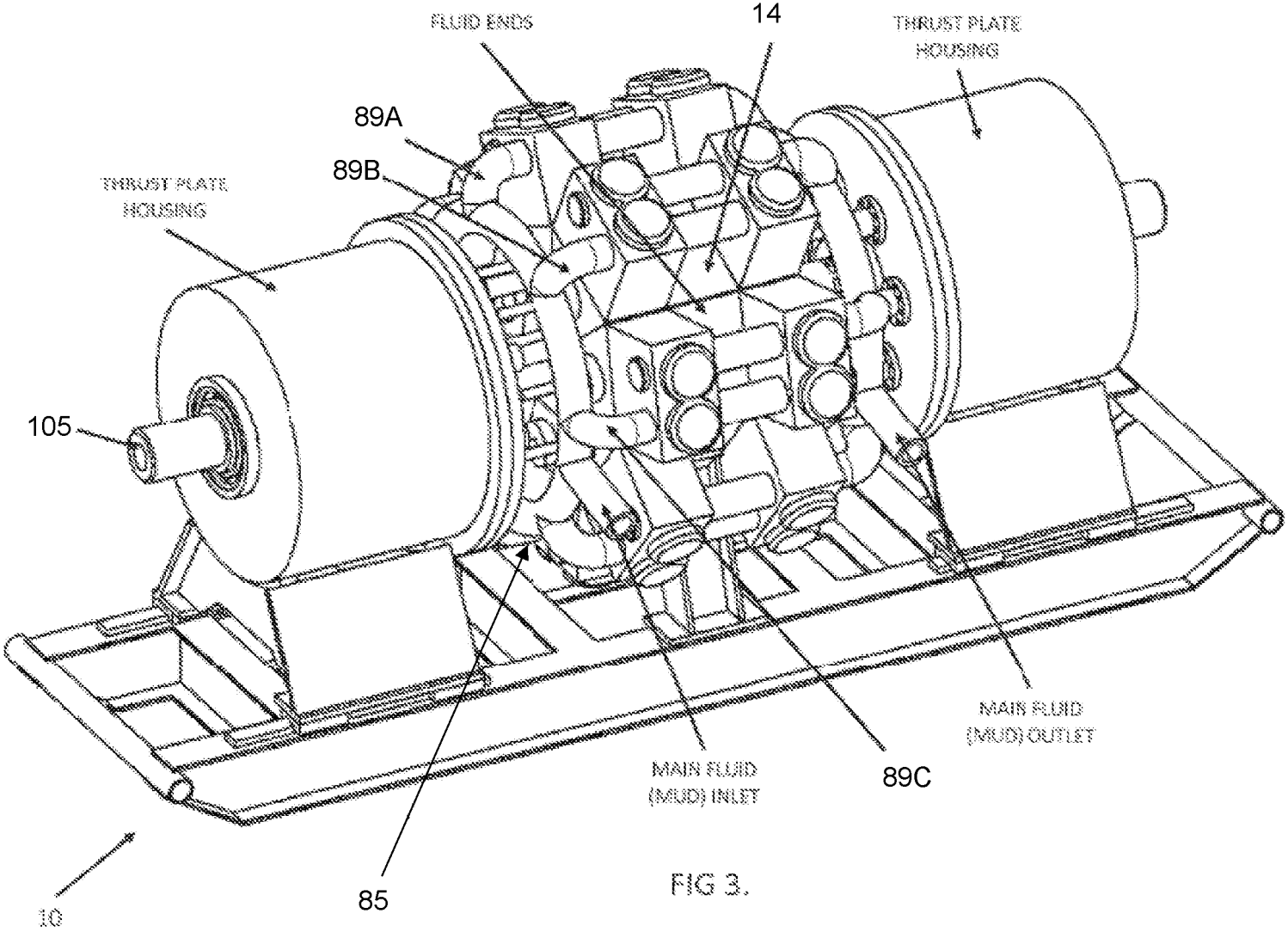
FIG. 3 is a perspective view of an arrangement that may be used as a double acting pump utilizing two rotating tapered discs in one example embodiment of the disclosure.

Referring to FIG. 3, a perspective view of the arrangement 10 is illustrated. The arrangement 10 allows for fluid flow through the arrangement 10 during movement of a piston 12, illustrated in FIG. 6, placed within a block 14, illustrated in FIG. 10. The piston 12, in one non-limiting embodiment, may be actuated by a mechanical actuator. Different types of mechanical actuators may be provided, such as a pump. Fluid is provided to each block 14 by a fluid feeding system 85. The fluid feeding system 85 may include a header 87 that has individual feed lines 89A, 89B, 89C, etc. transmitting fluid to the block 14. The fluid feeding system 85 may be computer controlled such that a constant supply of fluid is provided to the pump to prevent fluid starvation.

Figure 8A:
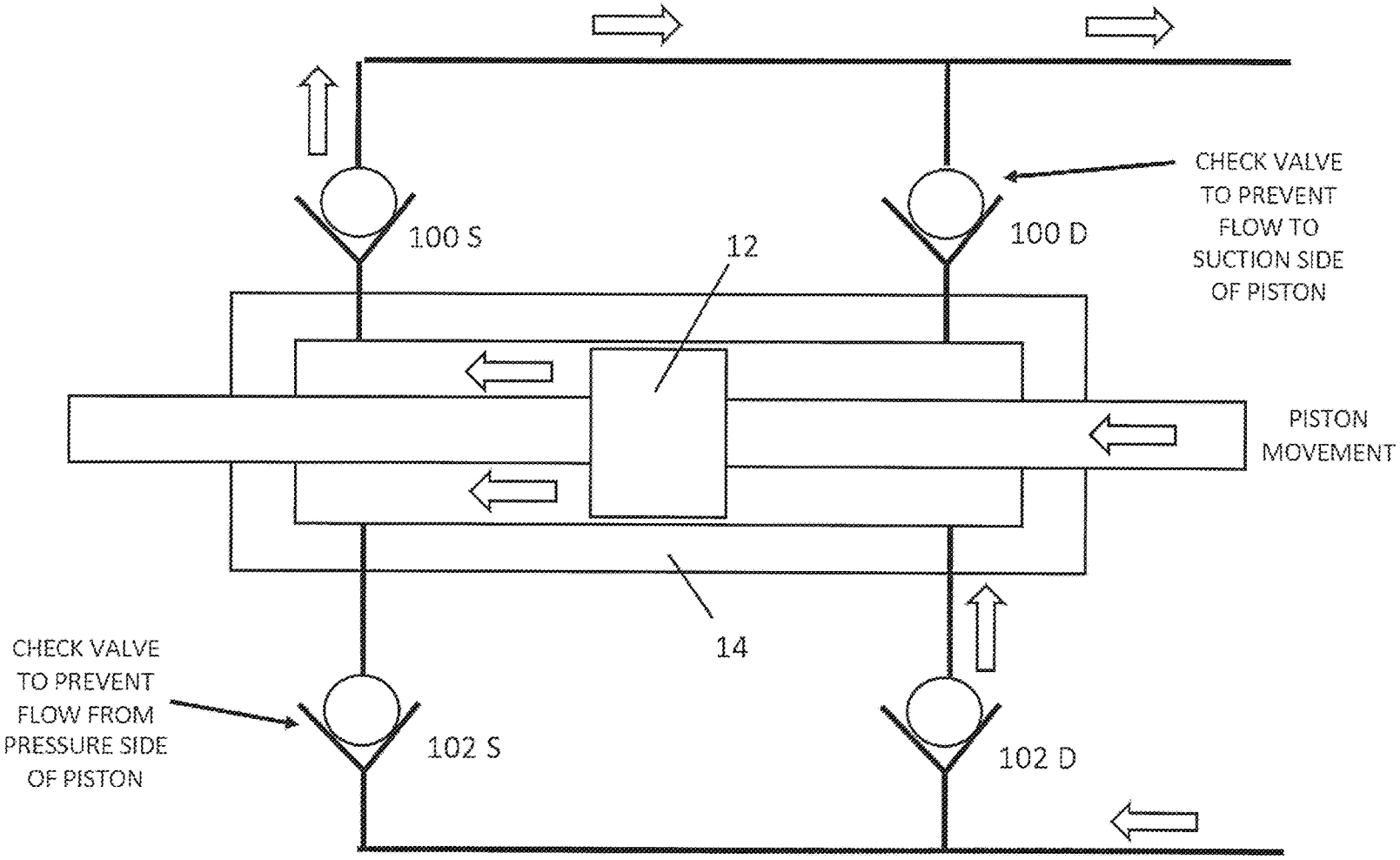
FIG. 8A is an arrangement drawing of fluid valves in one example embodiment of the disclosure with fluid flow in a first direction.
Figure 8B:
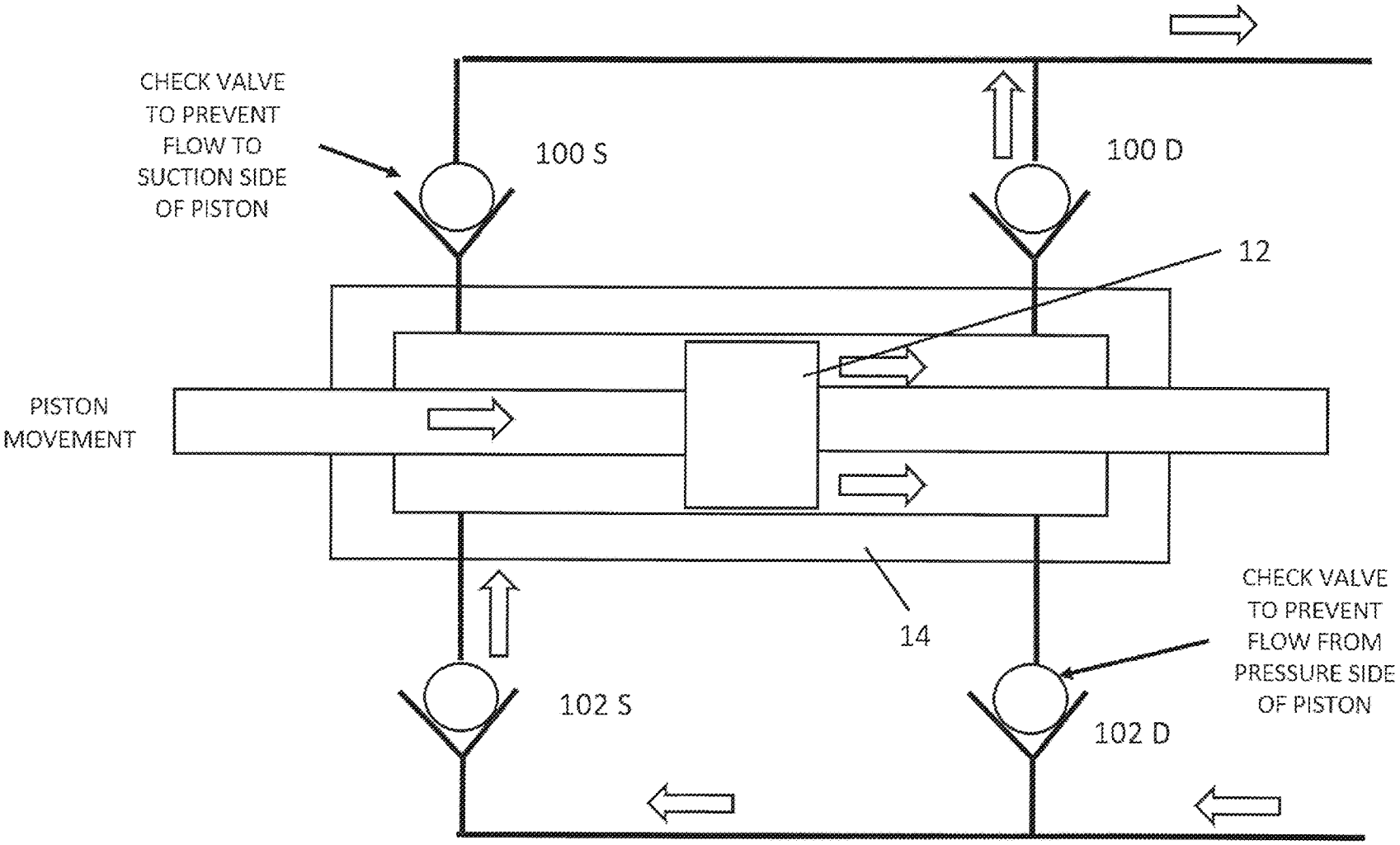
FIG. 8B is an arrangement drawing of fluid valves in another example embodiment of the disclosure with fluid flow in a second direction.
Figure 9:
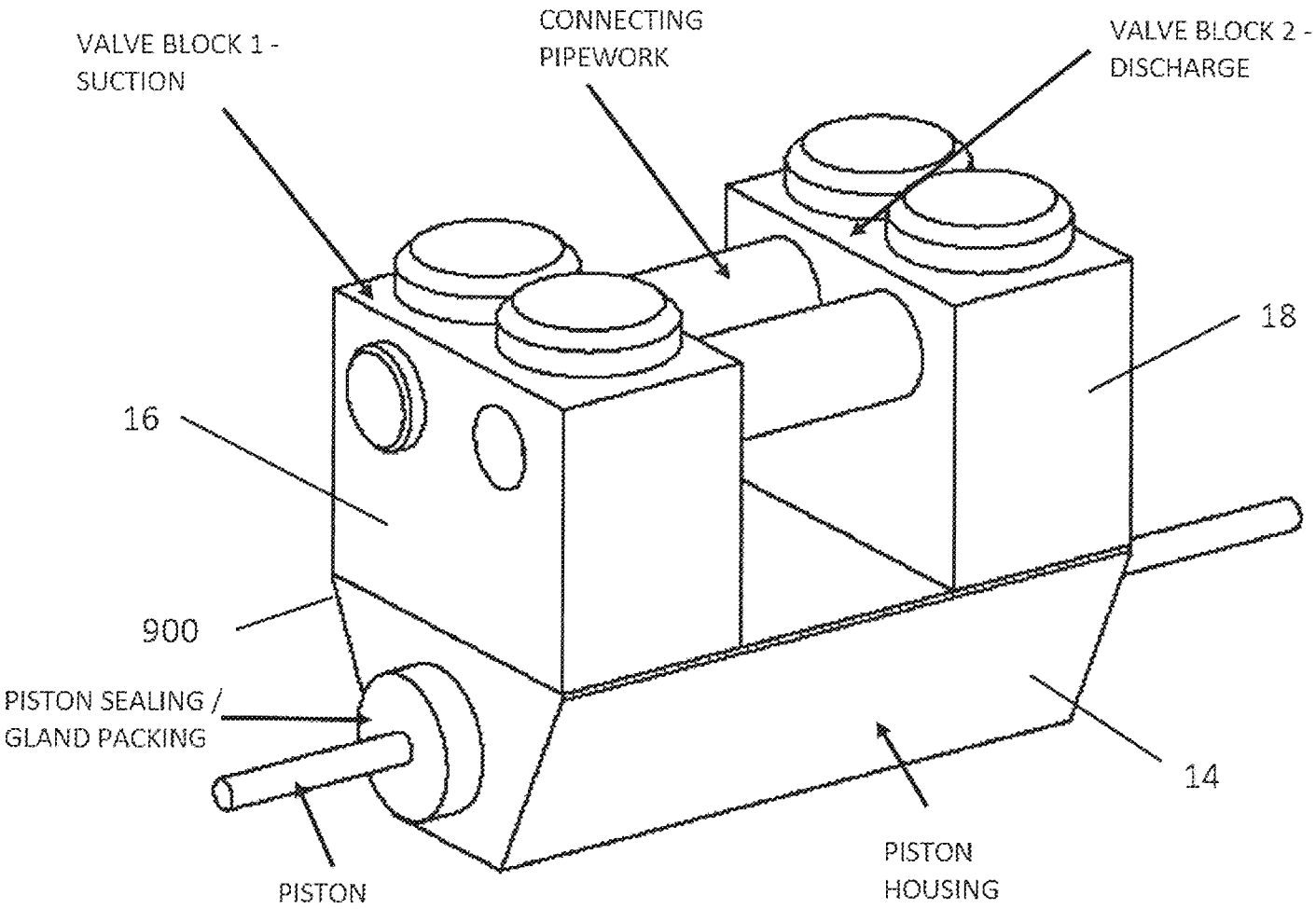
FIG. 9 is perspective view of a fluid end/check valve arrangement in one non-limiting embodiment of the disclosure.

In embodiments, as illustrated in FIG. 9, a first housing 16 used in FIG. 3, is shown in more detail. As will be understood, numerous housings can be used within an arrangement 10 according to the number of blocks 14 provided. Generally, the number of blocks 14 is an odd number. Each of the blocks 14 is provided with first and second housings 16, 18. The housings 16, 18 are provided to house the associated valving to conduct the fluid to and from the arrangement 10. In one example, housing 16 is provided to house a suction check valve 100S and a discharge check valve 100D, wherein the valves are illustrated in FIGS. 8A and 8B. These check valves 100S, 100D are provided to ensure that fluid flow occurs in a specific direction. A second housing 18 is also provided. Two fluid connections are provided between the first housing 16 and the second housing 18. Fluid may pass through the two fluid connections provided. The second housing 18 provides a second suction check valve 102S and a second discharge check valve 102D. The connections are provided such that the suction check valve 100S links to the second suction check valve 102S through a spool. The second fluid connection links the discharge check valve 100D to the second discharge check valve 102D through a second spool. The first housing 16 and the second housing 18 are connected to the block 14, through, for example, a first bolted connection 900 (between the first housing and the block 14) and a second bolted connection 902 (between the second housing 18 and the block 14).

In embodiments, the check valves 100S, 100D, 102S, 102D are self-contained units that may be placed within the first or second housing 16, 18 as appropriate. The self-contained units may be a cartridge style unit such that maintenance for the arrangement 10 is superior compared to conventional apparatus.

In embodiments, the arrangement 10 may be made of metallic materials to provide for long-term and maintenance free operation. Such materials may be, for example, stainless steel, carbon steel or other similar materials.

In embodiments, the arrangement 10 is used to pump a fluid, such as a mud used in oil and gas exploration and recovery operations. The arrangement 10, as described above, may operate in a double acting fashion. Two discs 102, 104 are mounted on a shaft 105. The discs 102, 104 are located at a known or "fixed" distance apart from the other disc. Each of the discs 102, 104 are mounted on the shaft 105 through use of a spline 111. The rotating discs 102, 104 are provided such that the discs amount of space between facing portions of the rotating discs 102, 104 is the same value. Thus, when the discs 102, 104 rotate in the same direction, a piston connected between the discs is moved (translated) back and forth during disc rotation.

The arrangement 10 is further configured with a number of blocks 14. Each of the blocks 14 is provided with at least one void 30 within each of the blocks 14. The blocks 14 are arranged in a pattern between the parallel tapered rotation discs 102, 104. The arrangement 10 may be in a radial configuration. The rotation discs 102, 104 each have an internal bore 107 that includes a spline feature 111. This spline feature 111 allows the discs 102, 104 to engage with the shaft 105. The splines 111 also allow the thrust plate housing to translate for maintenance purposes, i.e. slide along the spline 111. The shaft 105 provides the interface for the input drive system, and also makes the connection across the pump between the rotation discs 102, 104 to ensure they are synchronously timed with each other. The shaft 105 acts as a connection between the two rotation discs 102, 104.

Each of the blocks 14, is provided with a piston 12 that interfaces with the block 14, wherein the piston 12 is placed within the at least one void 30 of each of the blocks 14. The piston 12 is configured to move from a first position 120 to a second position 130. This movement may be, for example, in a linear motion. Each of the blocks 14 is configured to be connected to a first housing 16 with a suction side 22 and a discharge side 24. In a similar fashion, each of the blocks 14 is configured to be connected to a second housing 18, each with a suction side 28 and a discharge side 31. The first 16 and second 18 housings are described above in relation to FIG. 9.

The piston 12 may move from a first position 120 to a second position 130. The movement may be achieved though a mechanical connection to the piston 12. In one embodiment, the mechanical connection is configured such that an end of the piston 12 contacts an associated tapered rotating block.

In one non-limiting embodiment, the first housing 16 is connected to the block 14 through a first bolted connection 900. In one non-limiting embodiment, the second housing 18 is connected to the block 14 through a second bolted connection 902. Although described as a bolted connection, other connection types are possible and as such, the illustrated embodiment should not be considered limiting.

Figure 10:
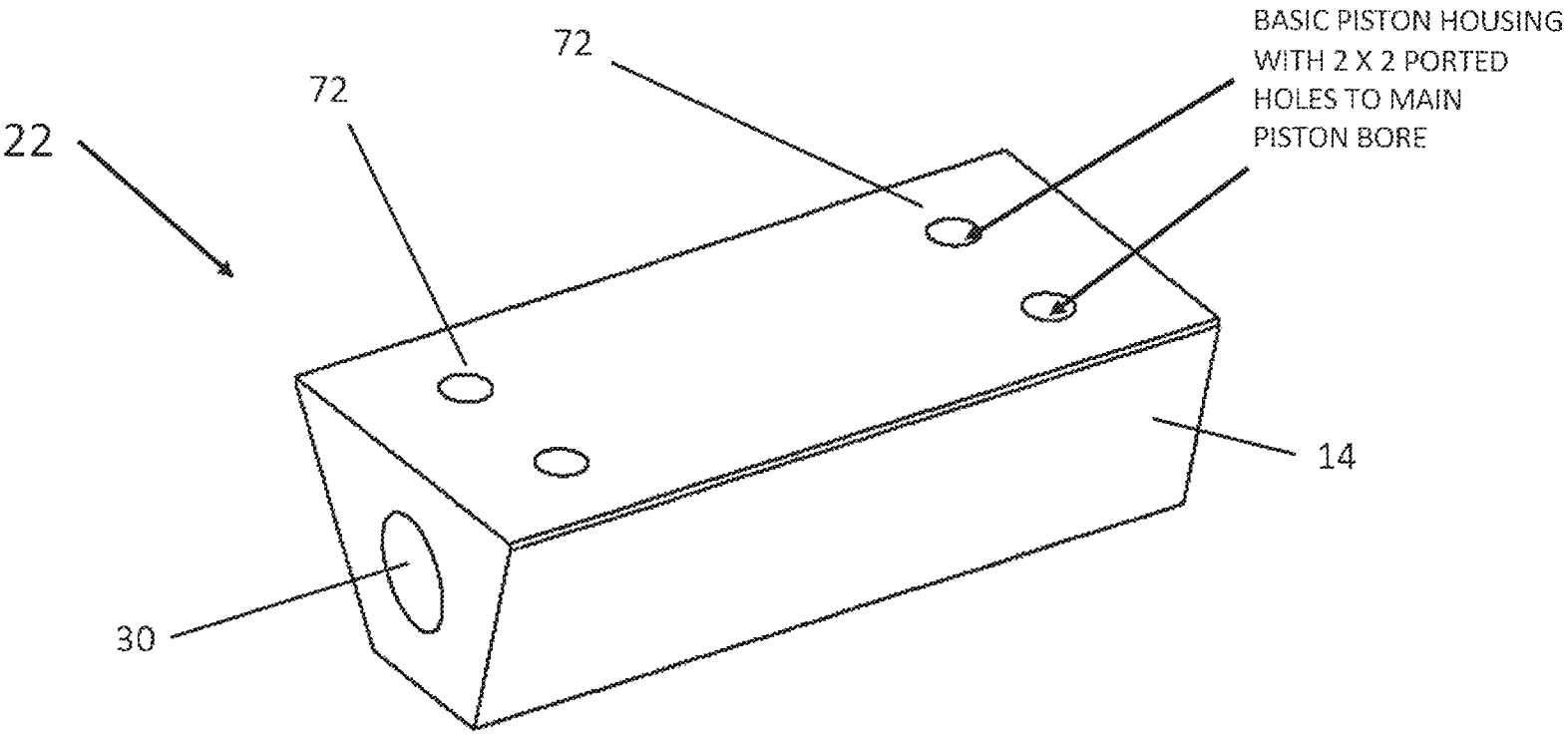
FIG. 10 is perspective view of a block with a void into which a piston is positioned as part of the double acting fluid end rotating thrust plate pump.

Referring to FIG. 10, a block 14 for the arrangement 10 is illustrated. The block 14 is configured with a void 30 that allows a piston 12 to move from a first position 120 to a second position 130 within the block 14. The piston 12 is configured such that a snug fit is maintained between the piston 12 and the block 14. In embodiments, the piston 12 may be configured with rings to help provide a tight seal between the piston 12 and the block 14. The block 14 is configured with a first set of auxiliary holes 70 and a second set of auxiliary holes 72. The first set of auxiliary holes 70 and the second set of auxiliary holes 72 are configured with a connection with the void 30 such that movement between the first set of auxiliary holes 70 and the void 30 as well as between the second set of auxiliary holes 72 and the void 30. The first set of auxiliary holes 70 and the second set of auxiliary holes 72 are configured to allow fluid to travel into and out of the block 14 and through valves that will be housed in a first housing 16 and second housing 18, described later. The valve arrangements may be as described in relation to FIGS. 8A and 8B, in one non-limiting embodiment.

Mud is provided to the pump via a lower suction manifold which distributes the mud to the fluid ends. Typical pump configurations are three (3) fluid ends referred to as a triplex pump or five (5) fluid ends referred to as a quintuplex pump. Mud may be mixed separately from the configurations shown in equipment known in the art.

The arrangement 10 is also unique and reconfigured to a radial setup, allowing a greater density of components. For the example illustrated 3 below depicts a 7 piston/7 arrangement. However, any other odd number of pistons and fluid ends (3, 5, 7, etc.), can be utilized depending on pump pressure and flow volume performance requirements. The design is uniquely flexible, providing a scalable design, based on number of fluid ends; stroking of the piston 12 (movement) and the power capacity available to drive the pump.

Two Rotating Tapered Discs

Figure 4:
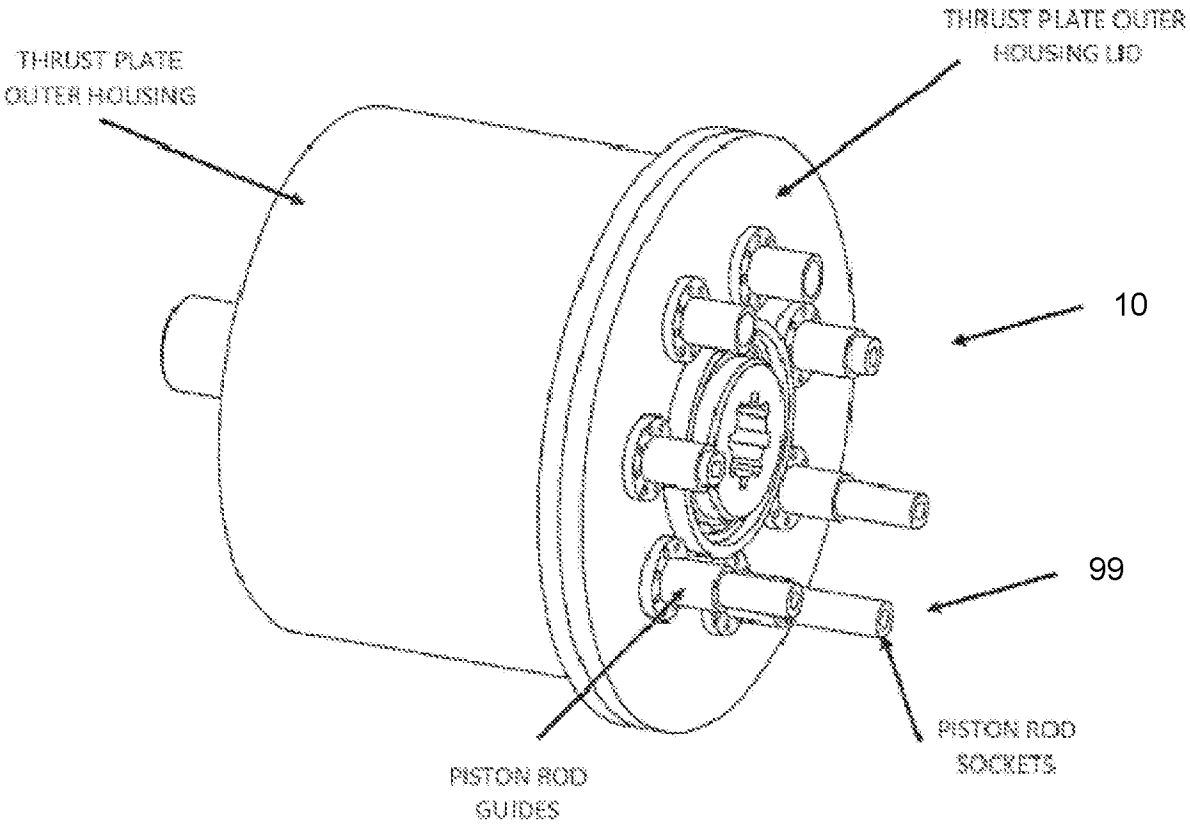
FIG. 4 is a perspective view of a thrust plate outer housing and connecting equipment.
Figure 5:
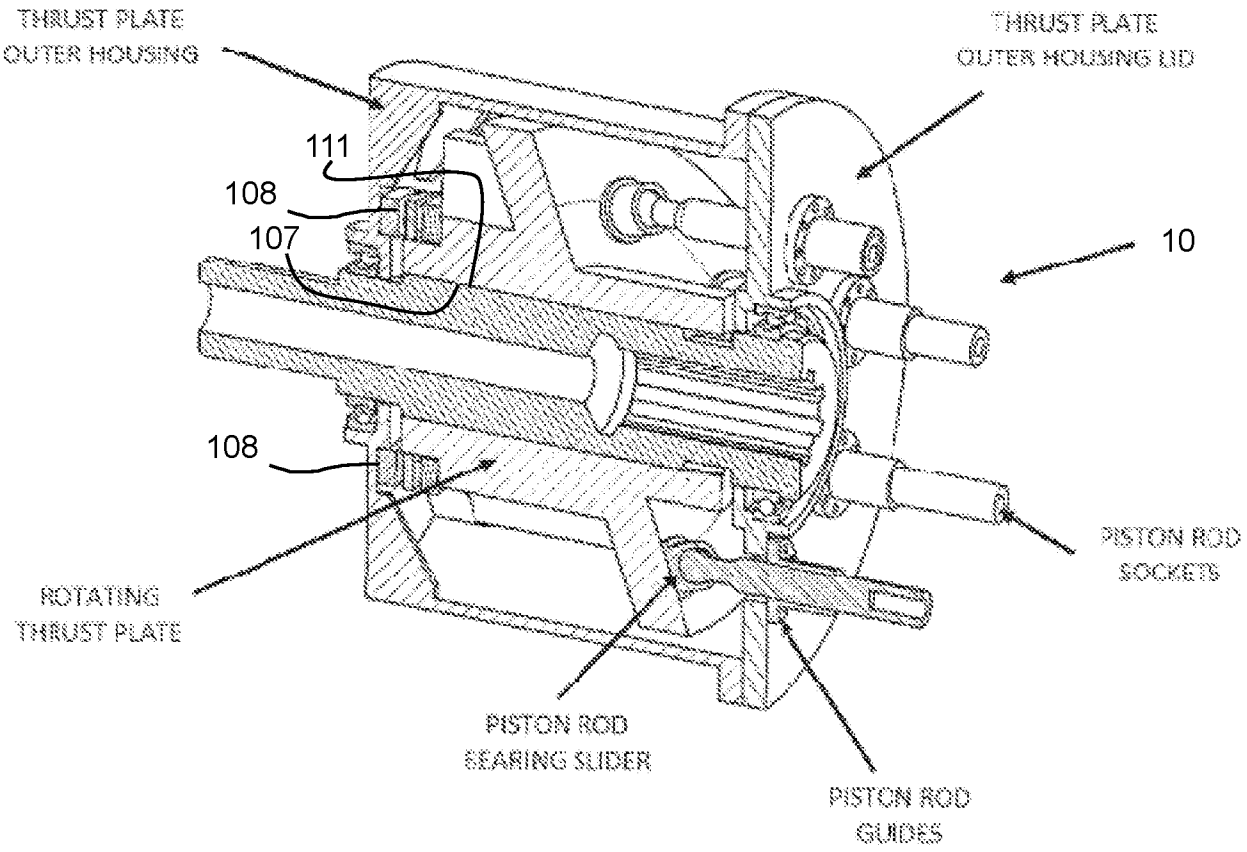
FIG. 5 is a cross-sectional view of the thrust plate outer housing of FIG. 4.

Referring to FIGS. 4, 5 and 6, two rotating tapered discs 102, 104 are used to actuate each piston 12. The two rotating tapered discs 102, 104 are located within the outer housing mounted on bearings 106. Bearings 106 support the longitudinal loads developed during rotation of the thrust plate while allowing rotation of discs 102, 104 relative to the outer housing. The outer housing and outer housing lid provide a sealed chamber for oil lubrication. The outer housing and outer housing lid are each supported on the shaft 105 by means of bearings 108 that allow rotation of the outer housing and outer housing lid relative to the shaft 105. Attached to the lid are a number of guide sleeves. The piston rods 99 reciprocate with the guides. One end of the piston rod 99 has a socket arrangement as the receiving location for the piston rods 99 held within the fluid end. The opposing end of the piston rod 99 is a spherical ball arrangement with allows articulation between the thrust plate angled surface to the piston rod 99, allowing a linear action to be generated.

Double Acting Fluid End and Check Valve Arrangement

A conventional fluid end arrangement (FIG. 7.) has a two (2) item, check valve arrangement. A first check valve on the inlet side, referred to as a suction valve, allows fluid to be drawn into the fluid end via the piston 12 action on the backward stroke. A second check valve on the outlet side, referred to as the discharge valve, allows pressurized fluid flow out of the fluid end. Should a backflow of fluid be caused, the check valves prevent any backflow within the fluid end.

For example, as fluid is being drawn into the fluid end, the lower suction check valve allows unrestricted flow. However, as pressure is development within the main fluid end bore via the forward action of the piston 12, the check valve then seats fully, preventing any fluid flow out through the lower (inlet) aperture. Similarly, the upper discharge check valves allow flow outlet, while preventing any flow into the fluid end via the upper check valve.

Figure 7:
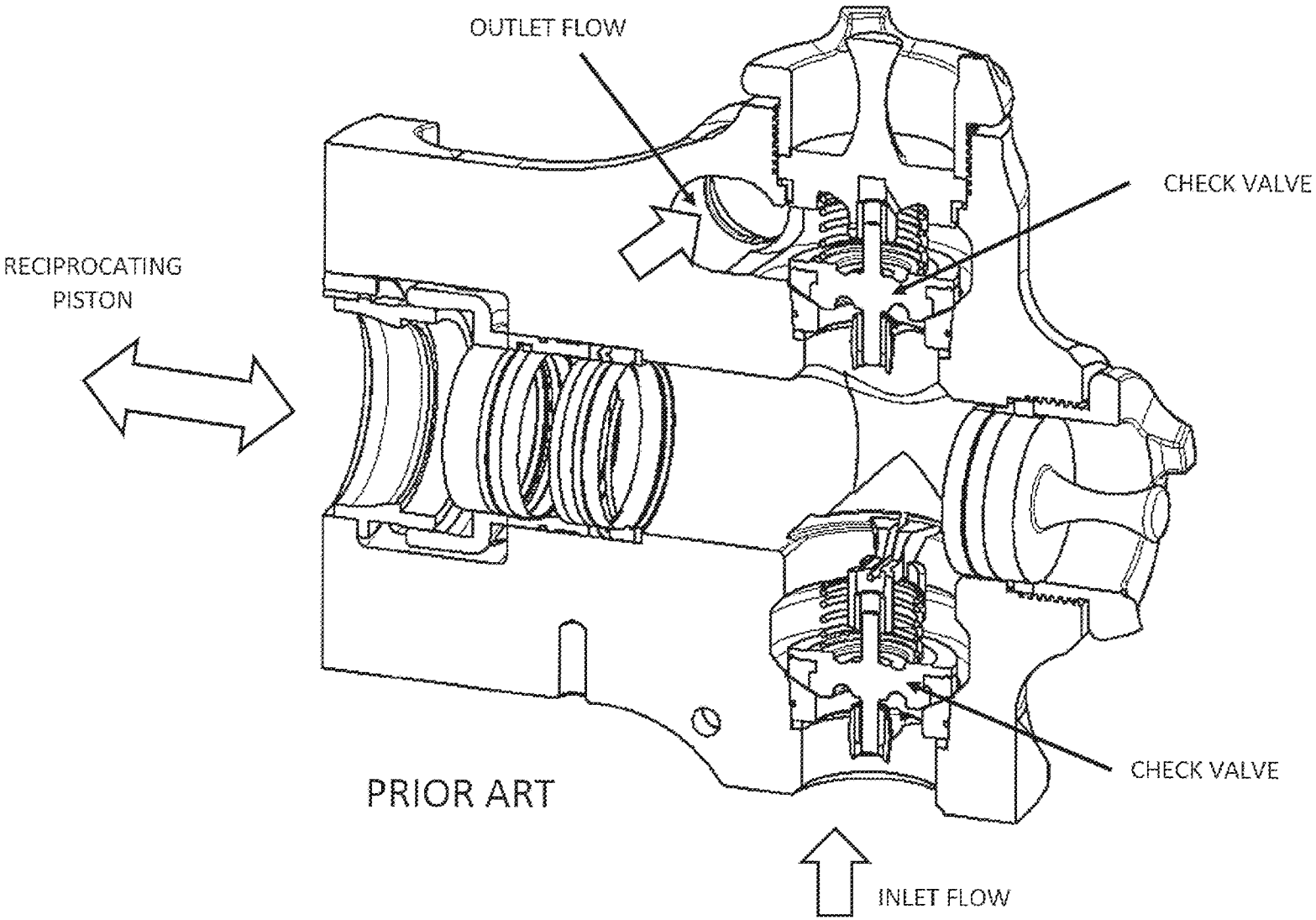
PRIOR ART FIG 7.
FIG. 7 is a conventional fluid end arrangement.

Aspects of the disclosure provide a different configuration than the conventional apparatus in FIG. 7. FIGS. 8A and 8B provide a double acting design. As the disclosed embodiment is a double action piston 12 arrangement, pressure and flow can be created in both directions, adding to the efficiency of the pump. By combining four (4) check valves, within the inlet and outlet ports, in one embodiment, the fluid is configured to produce pressure and flow in both piston directions.

With a combination of two (2) suction and two (2) discharge check valves, per FIGS. 8A & 8B, the pressure discharge is available in both directions of the piston 12 movement, while preventing any backflow to the suction side of the arrangement, ensuring discharge flow is in one direction only. To facilitate the block 14 and first 900 and second 902 housings have associated pathways for fluid to be transported. (See, FIG. 9).

Check Valve Cartridge

Per the description of FIG. 7. above for conventional apparatus, check valves are used in the conventional setup, but tend to be 'disk' like arrangements, i.e., a disk with elastomer face seats against a mating surface to provide the sealing function. However, as can be seen the flow path can be quite torturous through the valve arrangement, which in some cases causes 'wash out'—a phenomenon, where the turbulent flow of the fluid starts to erode the flow path walls/components. This results in physical damage to the components meaning they have a reduced service life and require constant maintenance.

To address the issue of the check valve wash out, embodiments of the disclosure provide a valve arrangement that eliminates wash out and that can be used in both suction and discharge operations. Additionally, aspects of the disclosure, as illustrated in FIGS. 8A and 8B, create a smooth flow when the valve is opened for the flow condition, reducing turbulent flow potential, and consequently extending service life.

In embodiments, after an extended operation period, it is anticipated the whole check valve cartridge just simply be removed from the main flow body and replaced as a whole, resulting in reduced service requirements.

Figure 11A:
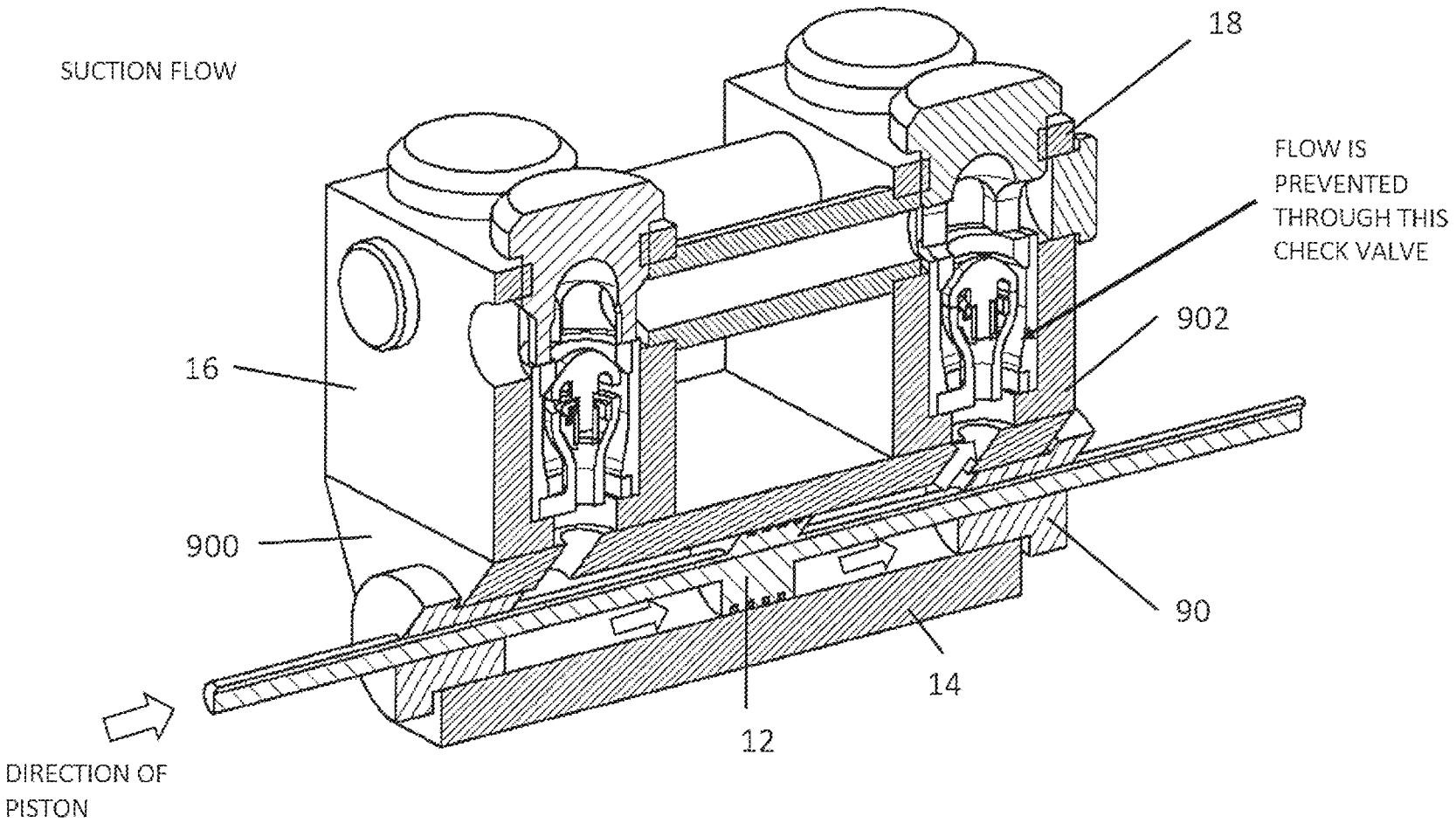
FIG. 11A is a cross-section of a piston and block arrangement channeling flow.
Figure 11B:
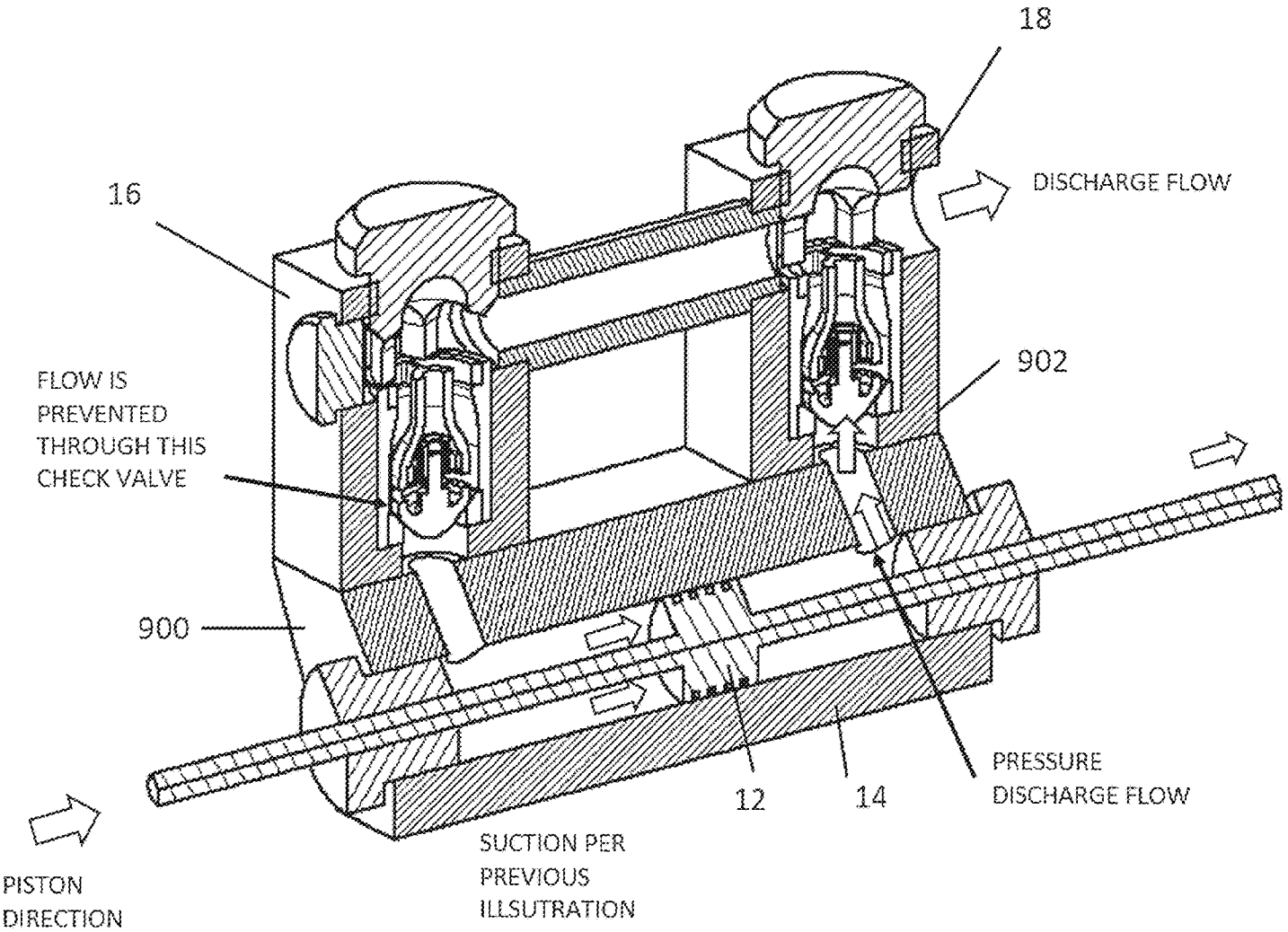
FIG. 11B is a cross-section of the piston and block arrangement of FIG. 11, during a discharge flow event through the housing.

Referring to FIGS. 11A and 11B, flow paths for fluids being processed through the piston 12 and the first and second housings 900, 902 are illustrated. In FIG. 11A, the direction of the piston 12 is travelling to the right, causing a compression stroke on the right side of the block 14. Fluid, squeezed between the piston 12 and the block 14 goes under pressure. Movement of the piston 12 to the right, causes a suction flow of fluid on the left side of the piston 12, through a suction valve. Once fluid pressure at the right increases to a desired level, referring to FIG. 11B, the discharge valve above the piston 12 to the right opens, allowing the pressurized fluid to exit. As will be understood, the piston 12 will then travel to the left side of the block 14, thereby pressurizing the fluid. After reaching the desired pressure level, a discharge valve at the left will open, allowing the fluid to escape. During movement of the piston 12 to the left, a suction valve at the right of the block 14 will open, allowing fluid to enter the right side of the piston 12.

Figure 12A:
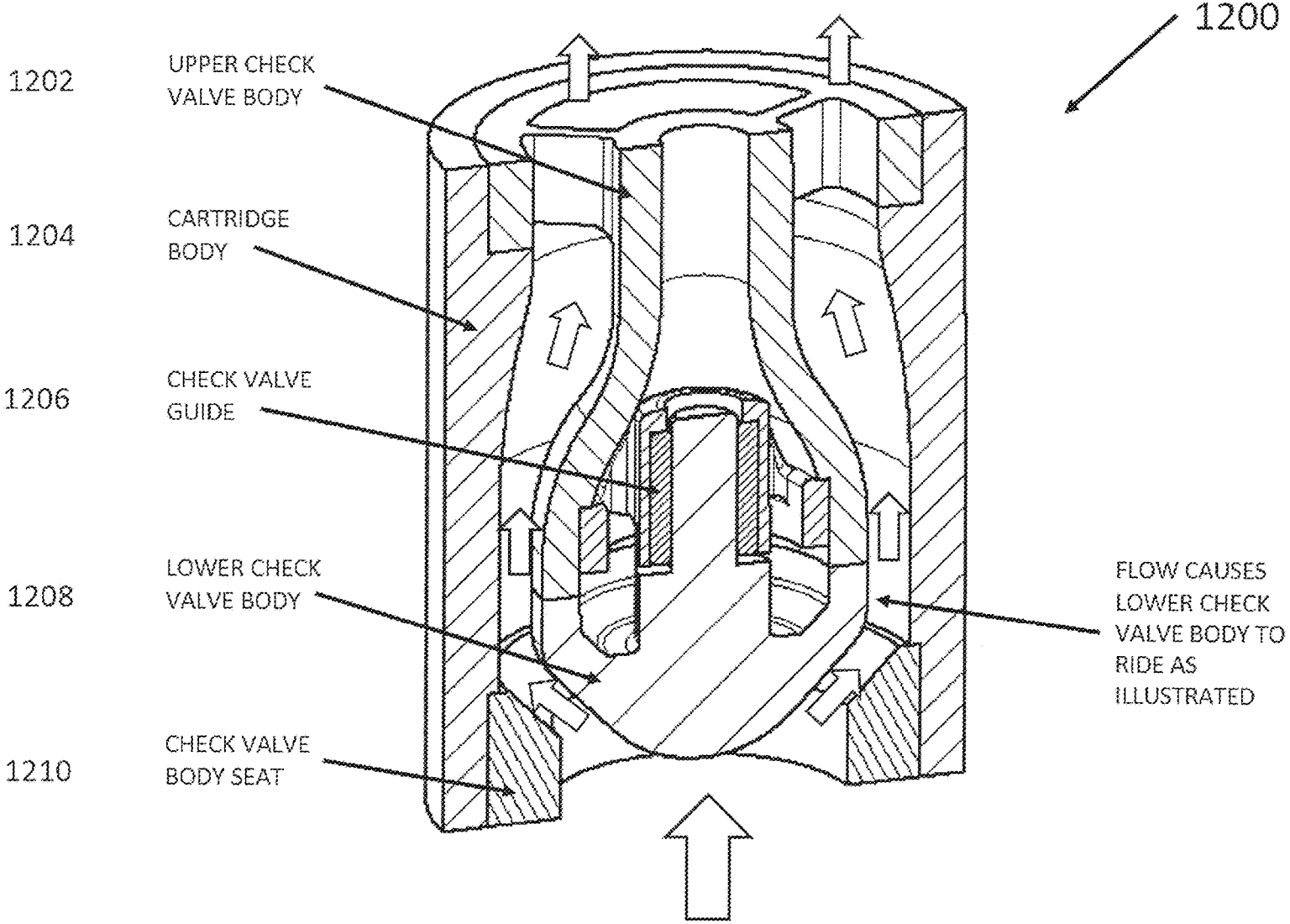
FIG. 12A is a cross-section of a valve with a fluid flow being processed in a first direction.
Figure 12B:
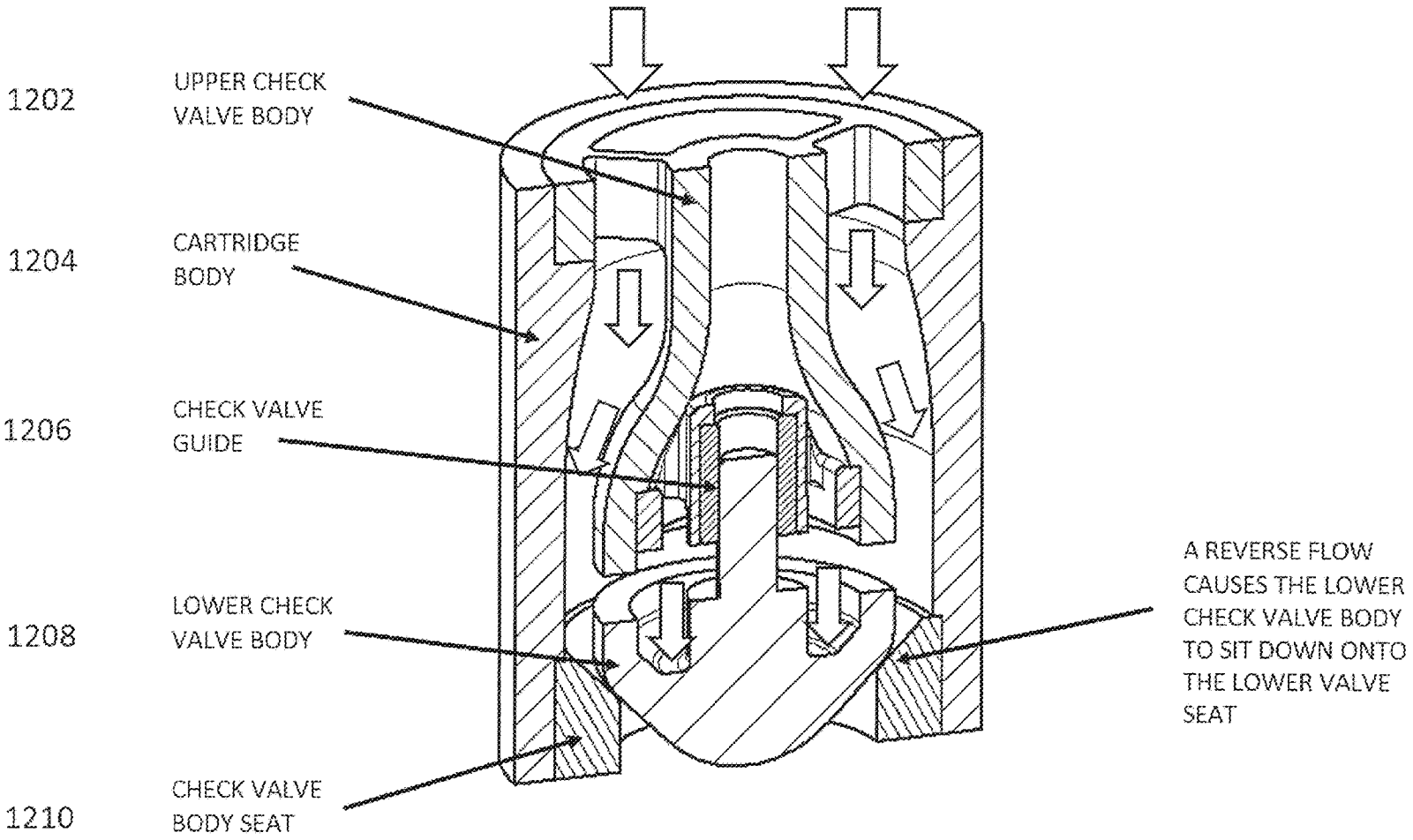
FIG. 12B is a cross-section of a valve with a fluid flow being processed in a second direction with the valve internals reversed.

Referring to FIGS. 12A and 12B, a cross-section of the valves used in the arrangement 10 is illustrated. The valves 1200 are cartridge type valves that may be easily installed. Each valve 1200 provides an upper check valve body 1202, a cartridge body 1204, a check valve guide 1206, a lower check valve body 1208 and a check valve body seat 1210. In FIG. 12A, flow to the bottom of the valve 1200 causes the lower check valve body 1208 to be positioned as illustrated. In FIG. 12B, where flow is reversed, the lower check valve body 1208 is repositioned as illustrated. Such valves may be used to prevent flow in one direction, as a non-limiting embodiment. The valve 1200 may be used in both the suction valves 100S, 102S and discharge valve 100D, 102D positions described in relation to FIG. 8A and FIG. 8B.

Flow, Pressure and System Loading Benefits of Aspects of the Disclosure Compared with Conventional Apparatus Prototypes of the arrangement 10 were constructed and tested. Operational parameters of conventional apparatus are compared to the arrangement 10 described above, illustrating the advance in performance.

Example Of Conventional Apparatus

Single acting piston system

Piston size—4" diameter

Stroke—8"

Rod loading maximum—250 000 lb f

Operating Speed—250 rpm $$\text{Piston area} = \pi d^2/4$$
$$= \pi 4^2/4$$
$$= 12.57 \text{ ins}^2$$

Given a maximum rod load of 250 000 lb f, then the maximum pressure which be obtained would be:—

$$\text{Pressure} = \text{Force}/\text{Area}$$
$$= 250\ 000/12.57$$
$$= 19\ 889 \text{ psi}$$

$$\text{Flow Volume} = \text{area} \times \text{stroke}$$
$$= 12.57 \times 8$$
$$= 100.56 \text{ ins}^3 \text{ (per piston)}$$

$$\text{At operating speed} = 250 \text{ rpm}$$

$$\text{Total flow volume (per piston)} = 250 \times 100.56$$
$$= 25\ 140 \text{ ins}^3$$
$$\text{(108.8 US Gallon per minute)}$$

Embodiment of the Present Disclosure Example

Piston size—4" diameter

Piston Shaft—1.5"

Stroke—8"

Rod loading maximum—250 000 lb f

Operating Speed—250 rpm $$\text{Piston area} = \pi(D^2 - d^2)/4$$
$$= \pi(4^2 - 1.5^2/4$$
$$= 10.8 \text{ ins}^2$$

$$\text{Flow Volume} = \text{area} \times \text{stroke}$$
$$\text{(2 strokes per GARTECH development)}$$
$$= 10.8 \times 8 \times 2$$
$$= 172.8 \text{ ins}^3 \text{ (per piston)}$$

$$\text{At operating speed} = 250 \text{ rpm}$$

$$\text{Total flow volume (per piston)} = 250 \times 172.8$$
$$= 43\ 200 \text{ ins}^3$$
$$\text{(187.2 US Gallon per minute)}$$

Pressure—if we take the limiting factor as pressure from above (19 889 psi), then the equivalent rod load would be Pressure=Force/Area Transposing $$\text{Force} = \text{Pressure} \times \text{Area}$$
$$= 19\ 889 \times 10.8$$
$$= 214\ 801 \text{ lb } f$$

Summary—Comparing the flow, pressure, and load values

Single Acting

Flow=108.8 gpm (per piston)

Pressure=19 889 psi

Rod Load=250 000 lb f

Double Acting

Flow=187.0 gpm (per piston)

Pressure=19 889 psi

Rod Load=214 801 lb f

Thus, aspects of the disclosure provide a roughly 72% increase in flow compared to conventional apparatus.

Aspects of the disclosure provide a pressure generating capacity—19 889 psi.

Aspects of the disclosure reduce equivalent rod load by nearly 15%.

Aspects described provide a scalable design, where the number of pistons can be altered to suit operator requirements, while maintaining the operational benefits, i.e. 3 piston, 5 piston, 7 piston . . . etc., configurations.

In one embodiment, the 7-piston configuration illustrated, is of a comparable size and weight to a convention 3 piston (Triplex) mud pump. However, the performance of the pump vastly increases the flow and thus other embodiments are possible.

SUMMARY OF BENEFITS OVER CONVENTIONAL APPARATUS

Aspects of the disclosure provide a configurable and scalable design to match operator requirements.

Aspects of the disclosure provide a similar weight and footprint to conventional pumps, while having an increased fluid volume discharge.

Aspects of the disclosure provide for a more efficient double acting flow/discharge.

Aspects of the disclosure provide a check valve design to minimize turbulent flow within the entire design.

Aspects of the disclosure provide a simple cartridge design for valves, allowing for easy maintenance and long service life.

Aspects of the disclosure provide a more simple and robust configuration that provides superior maintenance capability.

Aspects of the disclosure provide a modular construction that has the capability of being easily manufactured.

Aspects of the disclosure also provide for:

1. Elimination of the crank shaft and associated components via two rotating parallel discs operating on the same axis thereby eliminating wear and failure points.
2. Replacement of a single acting piston or plunger with a double acting piston thereby increasing the output pumping volume, reducing the rod load, which increases pump life and safety.
3. Increasing the number of cylinder available to any odd number 3, 5, 7, 9, etc. thereby the pumps double acting capacity is further increased by a number of cylinders greater than 5.

4. Replacing single suction and discharge valves, with cartridge style dual suction and discharge valves, thereby facilitating the double acting piston or plunger and increasing valve life via the cartridge valve.

In one example embodiment, an arrangement is disclosed. The arrangement may comprise a shaft and two parallel tapered rotating discs bearing mounted on the shaft, such discs configured to rotate with the shaft, wherein a first portion of a first of the two parallel tapered rotating discs maintains a fixed distance between a corresponding second portion of a second of the two parallel tapered rotating discs during rotation of both of the two parallel tapered rotating discs with the shaft. The arrangement may also comprise at least one block arranged in a radial pattern between the two parallel tapered rotating discs; each of the at least one blocks having at least one void in each block. The arrangement may also comprise a piston located within the at least one void in the block, the piston configured to translate from a first position to a second position, between the tapered rotating discs. The arrangement may also comprise a first housing connected to the block, the first housing having a suction side and a discharge side, the first housing configured to channel a fluid. The arrangement may also comprise a second housing connected to the block, the second housing having a suction and a discharge side, the second housing configured to channel the fluid. The arrangement may also comprise at least a first suction check valve and a first discharge check valve located in the first housing. The arrangement may also comprise at least a second suction check valve and a second discharge check valve located in the second housing.

In another example embodiment, the arrangement may be configured wherein the translation of the piston from the first position to the second position occurs through actuation of a mechanical connection.

In another example embodiment, the arrangement may be configured wherein the mechanical connection is arranged so a first end of the piston is connected to a first of the rotating tapered discs and a second end of the piston is connected to a second of the rotating tapered discs.

In another example embodiment, the arrangement may be configured wherein the first housing is connected to the block through a first bolted connection.

In another example embodiment, the arrangement may be configured wherein the second housing is connected to the block through a second bolted connection.

In another example embodiment, the arrangement may be configured wherein each of the suction check valves is in a cartridge configuration.

In another example embodiment, the arrangement may be configured wherein each of the discharge check valves is in a cartridge configuration.

In another example embodiment, a method is disclosed. The method may comprise providing a fluid stream to a pump with two rotating tapered discs configured to rotate with a shaft and directing the fluid stream to at least one block having a piston. The method may also comprise rotating each of the two rotating tapered discs with the shaft, causing the at least one piston to translate with the at least one block, such translation creating both a suction and a compression within the block during the translation and moving the fluid stream in the at least one block during each compression stroke of the piston.

In another example embodiment, the method may be performed, wherein the fluid stream is a drilling mud.

In another example embodiment, the method may be performed, wherein the rotating of each of the two rotating tapered discs is at least 200 revolutions per minute.

In another example embodiment, the method may be performed, wherein the rotating of each of the two rotating tapered discs is approximately 250 revolutions per minute.

In another example embodiment, the method may be performed, wherein the moving the fluid stream in the at least one block during each compression stroke of the piston occurs in two directions of the piston.

In another example embodiment, the method may be performed, wherein the providing the fluid stream to the pump with two rotating tapered discs configured to rotate with a shaft is controlled by a fluid feeding system.

In another example embodiment, the method may be performed, wherein the fluid feeding system is computer controlled to feed a predetermined amount of fluid to the pump.

What is claimed is:

1. An arrangement, comprising:

a shaft;

two parallel tapered rotating discs mounted on the shaft, wherein each disc is configured to rotate with the shaft, and wherein each portion of a first of the two parallel tapered rotating discs maintains a fixed distance between a corresponding portion of a second of the two parallel tapered rotating discs during rotation of both of the two parallel tapered rotating discs with the shaft;

two outer housings and two outer housing covers, wherein each outer housing combines with an outer housing cover to form a sealed chamber, and wherein one tapered rotating disc is within each sealed chamber;

at least one block arranged in a radial pattern between the two parallel tapered rotating discs; each at least one block having at least one void;

a piston located within each at least one void in each block, each piston configured to translate from a first position to a second position, between the tapered rotating discs;

wherein each block comprises:

a first housing connected to the block, the first housing having a suction side and a discharge side, the first housing configured to channel a fluid;

a second housing connected to the block, the second housing having a suction side and a discharge side, the second housing configured to channel the fluid;

at least a first suction check valve and a first discharge check valve located in the first housing; and at least a second suction check valve and a second discharge check valve located in the second housing, wherein the radial pattern is defined as a measured distance away from a center of the shaft and wherein each piston travels between the first housing and the second housing.

2. The arrangement according to claim 1, wherein rotation of the shaft causes translation of each piston.

3. The arrangement according to claim 2, wherein a first end of each piston is connected to a first of the tapered rotating discs and a second end of each piston is connected to a second of the tapered rotating discs.

4. The arrangement according to claim 1, wherein each first housing is connected to respective block through a first bolted connection.

5. The arrangement according to claim 1, wherein each second housing is connected to respective block through a second bolted connection.

6. The arrangement according to claim 1 wherein each tapered rotating disc has an internal bore that includes a spline, and wherein each tapered rotating disc engages the shaft at the respective spline.

7. The arrangement according to claim 1 wherein the outer housings and the outer housing covers are each respectively mounted on the shaft by a bearing surrounding the shaft.

8. The arrangement according to claim 1, further including a bearing mounted between each tapered rotating disc and its respective outer housing and configured to support axial loads developed during rotation of respective tapered rotating disc.

9. The arrangement according to claim 1 wherein each sealed chamber allows for oil lubrication of equipment within the respective sealed chamber.

10. The arrangement according to claim 1 wherein the sealed chambers are arranged on the shaft such that their outer housing covers face each other and each piston extends between the tapered rotating discs and through the outer housing covers.

11. A pump, comprising:

a shaft;

two parallel rotating discs mounted on the shaft, wherein each rotating disc is configured to rotate with the shaft, and wherein each portion of a first of the two rotating discs maintains a fixed distance from a corresponding portion of a second of the two rotating discs during rotation of the two rotating discs with the shaft;

two outer housings and two outer housing covers, wherein each outer housing combines with an outer housing cover to form a sealed chamber, wherein one of the two parallel rotating disc is within each sealed chamber, and at least one double acting fluid end arranged in a radial pattern between the two parallel rotating discs wherein the radial pattern is defined as a measured distance away from a center of the shaft, and wherein each double acting fluid end comprises:

a block, each block including a void; each block including a piston located within the void of the block, the piston configured to translate from a first position to a second position within the void;

a first housing connected to the block, the first housing having a suction side and a discharge side, the first housing configured to channel a fluid;

a second housing connected to the block, the second housing having a suction side and a discharge side, the second housing configured to channel the fluid;

at least a first suction check valve and a first discharge check valve located in the first housing;

at least a second suction check valve and a second discharge check valve located in the second housing;

wherein the sealed chambers are arranged on the shaft such that their outer housing covers face each other; and wherein each piston extends through the two outer housing covers and between the two rotating discs.

12. The arrangement according to claim 11 wherein each rotating disc has an internal bore that includes a spline, and wherein each rotating disc engages the shaft at the respective spline.

13. The arrangement according to claim 11 wherein the outer housings and the outer housing covers are each respectively mounted on the shaft by a bearing surrounding the shaft.

14. The arrangement according to claim 11, further including a thrust bearing mounted between each rotating disc and its respective outer housing and configured to support axial loads developed during rotation of the respective rotating plate.

15. The arrangement according to claim 11 wherein each sealed chamber allows for oil lubrication of equipment within the respective sealed chamber.

16. The arrangement according to claim 11 wherein the arrangement includes an odd number of double acting fluid ends.

17. The arrangement according to claim 11 wherein the arrangement includes seven double acting fluid ends.

18. A pump, comprising:

a shaft;

two parallel rotating discs mounted on the shaft, wherein each rotating disc has an internal bore that includes a spline, wherein each rotating disc engages the shaft at the respective spline so as to rotate with the shaft, and wherein each portion of a first of the two rotating discs maintains a fixed distance from a corresponding portion of a second of the two rotating discs during rotation of the two rotating discs with the shaft;

two outer housings and two outer housing covers, wherein each outer housing combines with an outer housing cover to form a sealed chamber, wherein one rotating disc is within each sealed chamber;

a thrust bearing mounted between each rotating disc and its respective outer housing and configured to support loads developed during rotation of the respective rotating disc; and at least one double acting fluid end arranged in a radial pattern between the two parallel rotating discs, wherein the radial pattern is defined as a measured distance away from a center of the shaft, and wherein each double acting fluid end comprises:

a block, each block including a void; each block including a piston located within the void of the block, the piston configured to translate from a first position to a second position within the void;

a first housing connected to the block, the first housing having a suction side and a discharge side, the first housing configured to channel a fluid;

a second housing connected to the block, the second housing having a suction side and a discharge side, the second housing configured to channel the fluid;

at least a first suction check valve and a first discharge check valve located in the first housing;

at least a second suction check valve and a second discharge check valve located in the second housing;

wherein the sealed chambers are arranged on the shaft such that their outer housing covers face each other; and wherein each piston extends through the two outer housing covers and between the two rotating discs.

19. The arrangement according to claim 18 wherein the outer housings and the outer housing covers are each respectively mounted on the shaft by a bearing surrounding the shaft.

20. The arrangement according to claim 18, wherein the thrust bearing is configured to support axial loads.

* * * * *